US010487423B2

(12) United States Patent
Riethmüller et al.

(10) Patent No.: US 10,487,423 B2
(45) Date of Patent: Nov. 26, 2019

(54) SENSORY YARN

(71) Applicant: Deutsche Institute für Textil- und Faserforschung Denkendorf, Denkendorf (DE)

(72) Inventors: Christoph Riethmüller, Leonberg (DE); Bastian Baesch, Stuttgart (DE); Simon Hoinkis, Stuttgart (DE)

(73) Assignee: Deutsche Institute für Textil-und Faserforschung Denkendorf, Denkendorf (DE)

( * ) Notice: Subject to any disclaimer, the term of this patent is extended or adjusted under 35 U.S.C. 154(b) by 322 days.

(21) Appl. No.: 15/128,854

(22) PCT Filed: Mar. 20, 2015

(86) PCT No.: PCT/EP2015/055985
§ 371 (c)(1),
(2) Date: Sep. 23, 2016

(87) PCT Pub. No.: WO2015/144597
PCT Pub. Date: Oct. 1, 2015

(65) Prior Publication Data

US 2017/0107647 A1 Apr. 20, 2017

(30) Foreign Application Priority Data

Mar. 24, 2014 (DE) ..... 10 2014 103 978

(51) Int. Cl.
*D02G 3/44* (2006.01)
*D02G 3/12* (2006.01)
(Continued)

(52) U.S. Cl.
CPC ..... *D02G 3/441* (2013.01); *D02G 3/12* (2013.01); *D03D 1/0076* (2013.01);
(Continued)

(58) Field of Classification Search
CPC ..... D02G 3/12; D02G 3/441; D03D 1/0076; D03D 1/0088
See application file for complete search history.

(56) References Cited

U.S. PATENT DOCUMENTS 2,114,496 A 4/1938 Keating
5,753,381 A * 5/1998 Feldman ..... D02G 3/441 313/506
(Continued)

FOREIGN PATENT DOCUMENTS

CN 1671901 A 9/2005
CN 101728005 A 6/2010
(Continued)

*Primary Examiner* — Shaun R Hurley
(74) *Attorney, Agent, or Firm* — Leydig, Voit & Mayer, Ltd.

(57) ABSTRACT

A sensor yarn (10) having a thread core (11) around which first and second conductors (12, 13) are helically wound. The two conductors (12, 13) are electrically insulated from each other and from the thread core (11). The two conductors (12, 13) form a capacitive component (15) together with the thread core (11). In one embodiment, the sensor yarn (10*a*) has a capacitance (Cl) per unit of length that changes in the direction of extent (E) of the sensor yarn. This can be accomplished by a change in the winding geometry of the first or second conductors (12, 13) or by a change of the relative permittivity (E) of the sensor yarn (10). In another embodiment, the sensor yarn (10*b*) has photosensitive material (30) and a length change is effected by an incident to the light (L). As a result of a length change or other deformation of the sensor yarn (10*a*, 10*b*), the total capacitance (CG) of the sensor yarn (10*a*, 10*b*) changes, which can be determined by means of an evaluating unit (17).

13 Claims, 4 Drawing Sheets

(51) Int. Cl.

| | |
|---|---|
| ***D03D 15/00*** | (2006.01) |
| ***D04B 1/14*** | (2006.01) |
| ***D03D 1/00*** | (2006.01) |
| ***D04B 1/12*** | (2006.01) |
| *D02G 3/36* | (2006.01) |

(52) U.S. Cl.
CPC ..... *D03D 1/0088* (2013.01); *D03D 15/00* (2013.01); *D04B 1/123* (2013.01); *D04B 1/14* (2013.01); *D02G 3/36* (2013.01); *D10B 2401/18* (2013.01); *D10B 2403/02431* (2013.01)

(56) References Cited

U.S. PATENT DOCUMENTS 5,927,060 A * 7/1999 Watson ..... D02G 3/12 337/163
7,413,802 B2 * 8/2008 Karayianni ..... D02G 3/328 428/370
2005/0040374 A1 2/2005 Chittibabu et al.
2005/0231207 A1 10/2005 Goldwater et al.
2008/0282665 A1 11/2008 Speleers
2010/0003496 A1 * 1/2010 Dias ..... A41D 27/085 428/222
2012/0225275 A1 * 9/2012 Honma ..... D02G 3/12 428/222
2014/0170920 A1 * 6/2014 Manipatruni ..... D03D 1/0088 442/188

FOREIGN PATENT DOCUMENTS

DE 10 2006 017340 A1 10/2006
DE 10 2008 003122 A1 7/2009
EP 2180091 A1 4/2010
WO WO 2006/128633 A1 12/2006
WO WO 2007020511 A1 2/2007

* cited by examiner

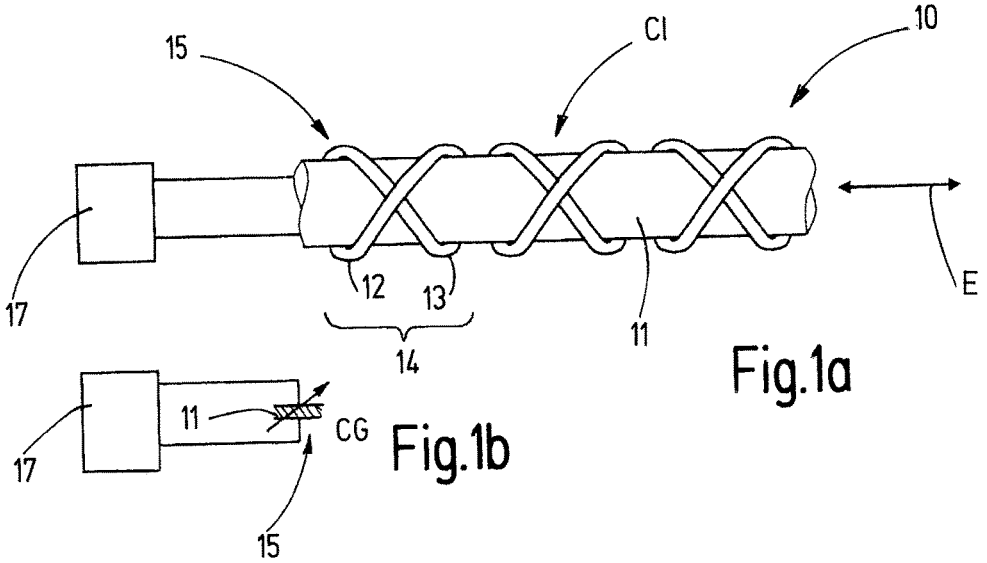
Fig.1a
Fig.1b
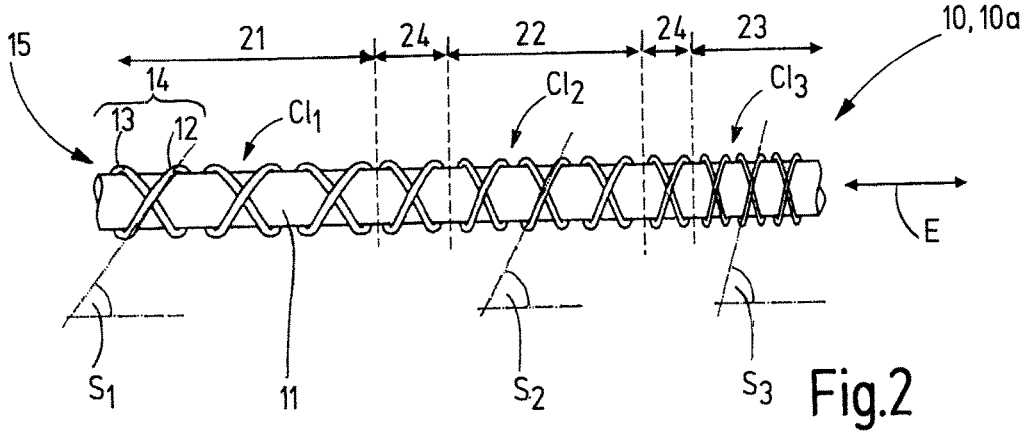
Fig.2
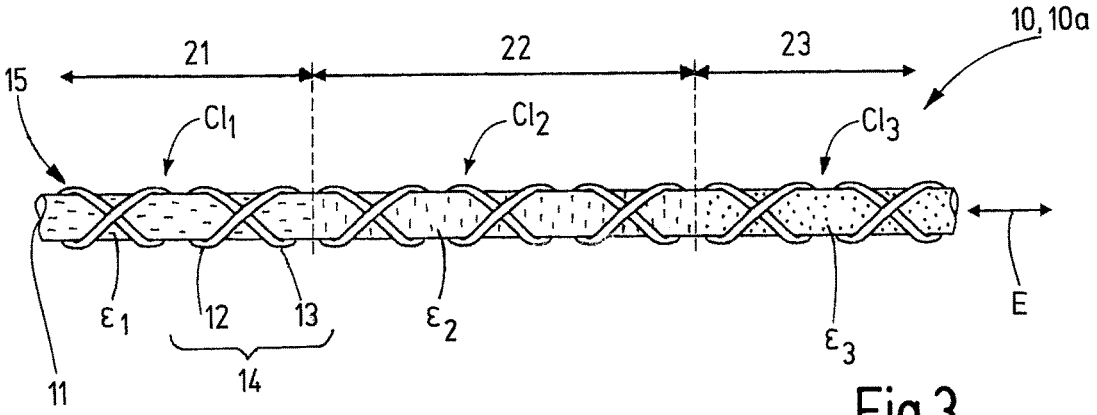
Fig.3

SENSORY YARN

FIELD OF THE INVENTION

The present invention relates to a sensory yarn for use in textile material.

BACKGROUND OF THE INVENTION

A sensory yarn commonly has a thread core with a longitudinal central axis extending along the length of the yarn, referred to as the direction of extent. The thread core may be monofilic or made of several fibers or filaments. Preferably, the thread core is elastically extendible in the direction of extent. The extensibility of the sensory yarn may be adapted to the material in which the sensory yarn is integrated, and thus, may vary within a wide range.

In order to produce a capacitive component a first conductor and a second conductor are wound in a screw-like or helical form relative to the direction of extent. The sensory yarn may be configured as a twisted yarn or as a wrapped yarn. Consequently, the two conductors can be wound in and/or around the thread core. The two conductors are electrically insulated relative to each other. For example, at least one of the two conductors can be insulated by a varnish or a coating around the electrically conductive core.

For example, a sensory yarn has been described in DE 10 2008 003 122 A1. In that reference, the yarn is disposed for the detection of tensile stresses in a medical knit fabrics or knits. The yarn has a core thread around which—in one exemplary embodiment—a covering thread may be wound. If the yarn is curved or stretched in its direction of extent, the electrical property of the yarn changes, i.e., for example the electrical conductivity and/or capacitance. For example, the covering thread may be a bimetal thread.

DE 103 42 787 A1 describes an electrically conductive yarn, wherein at least one electrically conductive thread is wound around a core thread.

DE 10 2006 017 340 A1 discloses another electrically conductive yarn. A non-conductive multi-filament yarn that, preferably, is to deposit itself in a planar manner on the core thread is additionally wound around the electrically conductive thread that is wound around the core thread, so that, in the event of a contact of two electrically conductive yarns in a textile material, there will not form an inadvertent electrically conductive contact.

Presently, sensory textile materials are used in the diverse fields of applications. For example, such sensory textile materials are able to detect pushing forces, pulling forces or the like. In many applications, localization of the affecting force is advantageous or necessary. Frequently, the sensory yarns are incorporated in a dense matrix-shaped pattern of the textile material so that a two-dimensional pattern of intersecting sensory yarns is formed. If a force acts at a specific location on this surface or if an object approaches this surface, it is possible—depending on the density of the sensory yarn—to determine a location of the force or the approach of an object by means of the sensory matrix.

The costs of manufacture for such sensory textile materials are great, as a result of which the textile material becomes accordingly expense. As a result of this, the use of sensory textile materials continues to be minimal.

OBJECTS AND SUMMARY OF THE INVENTION

It is an objective of the present invention to provide an improved sensory yarn. The subject sensory yarn may be configured as a wrapped yarn having a thread core or as a twisted yarn. The sensory yarn has at least one first conductor and at least one second conductor, wherein at least one of the two conductors is helically wound relative to the direction of extent of the sensory yarn. In doing so, the two conductors may be wound on the thread core—i.e., intersecting and/or with the same winding pitch next to each other without intersecting—or the thread core may have or form one of the two conductors (i.e. wrapped yarn). In the case of a twisted yarn, one or both conductors may be helically wound.

The two conductors are electrically insulated relative to each other, as a result of which the conductor pair of the at least one first conductor and at least one second conductor together with additional yarn components, for example the thread core, forms a capacitive component. The additional yarn components or the thread core represent the non-conductor of the capacitive component.

This capacitive component has a capacitance per unit of length that changes in the direction of extent of the thread core and thus in the direction of extent of the sensory yarn. The change of the capacitance per unit of length of the capacitive component may be continuous and/or in steps or in sections. For example, the capacitive component may have, in the direction of extent, successive yarn sections exhibiting different capacitances. In doing so, the capacitance per unit of length may be constant in a yarn section. It is also possible—at least sectionwise—to continuously change the capacitance per unit of length of the capacitive component, for example, to initially steadily increase from a minimum value to a maximum value of the capacitance per unit of length and/or to decrease from the maximum value to the minimum value of capacitance per unit of length. The pattern of continuously or sectionwise changing capacitance per unit of length may repeat as of a specific yarn length of the sensory yarn.

Two random sections of the sensory yarn may exhibit different capacitances per unit of length when they exhibit capacitances different from one another while having the same length.

With the use of the sensory yarn it is possible to detect a force acting on the sensory yarn, for example a pushing force and/or pulling force, a force change, a media charge with a liquid or vaporous medium or the approach of an object, a temperature change (due to the position change of the sensory yarn), or the like.

Due to the capacitance per unit of length that changes in a targeted manner in the direction of extent it is possible to achieve a local resolution in the direction of extent. The reason being, that an effect to be sensed and that is acting on the sensory yarn now depends not only on the type and the degree of the effect but also on the location at which the effect acts on the sensory yarn. For example, the total capacitance of the sensory yarn having a specific length changes depending on the capacitance per unit of length exhibited by the capacitive component at the location of effect. Consequently, it is possible by means of the sensory yarn according to one embodiment of the invention to provide a sensory textile material part, wherein the sensory yarns are no longer crossed in a matrix but can be arranged only parallel to one another in one direction. In the event of an effect that is to be sensed, the total capacitance of a sensory yarn incorporated in the textile material part changes. Generally, for example when the textile material is touched or when the textile material part is approached, the total capacitances of several sensory yarns are impaired. As a result of the fact that the capacitance of each capacitive sensor of a sensory yarn changes in the direction of extent, this allows a detection of the position. The production of a sensory textile material part may be clearly simplified. In particular, the electrical contact of a sensory textile material part on a single side may be sufficient because the sensory yarns are no longer superimposed in a crossed manner in two directions as before. As a result of this, the manufacture of a sensory textile material is simplified.

Preferably, the capacitance per unit of length of the capacitive component in a first yarn section is different from the capacitance per unit of length in another, second, yarn section of the sensory yarn. In particular, at least two yarn sections may be present, each being associated with a substantially constant capacitance per unit of length. For example, the first yarn section may have a first capacitance per unit of length, the second yarn section may have a second capacitance per unit of length, a third yarn section may have a third capacitance per unit of length, etc. Between each of such yarn sections exhibiting different capacitances per unit of length, there may be a transition section in which the capacitance changes steadily. Depending on the measure that is used for changing the capacitance per unit of length, it may be necessary—due to manufacturing engineering reasons—to provide such a transition section. The reason being that it is not always possible to increase or decrease the capacitance per unit of length at one location of the sensory yarn in jump-like fashion.

In the exemplary embodiment, the change of the capacitance per unit of length in the direction of extent is at least 0.03 pF and/or a maximum of 250 pF. For example, two or more yarn sections may be present, wherein the capacitance of successive yarn sections changes—with optionally interposed transition sections—by at least 0.03 pF, respectively. The difference between a yarn section exhibiting a minimum capacitance per unit of length and a yarn section with a maximum capacitance per unit of length may be up to 250 pF or greater.

In order to change the capacitance per unit of length of the capacitive component in the direction of extent, it is possible to use one or more measures. In one exemplary embodiment, changing the capacitance per unit of length can be effected in that a change of the number of windings per unit of length of the thread core is provided. Alternatively or additionally, it is also possible to change the pitch of the helical winding of the at least one first conductor and/or the at least one second conductor. The pitches of the helical windings of the two conductors may be the same and/or exhibit the same value in a shared yarn section. However, it is also possible for the pitch of the two conductors in a shared yarn section to be different in view of the amount and/or the value.

An additional or alternative measure for changing the capacitance per unit of length of the capacitive component can be accomplished in that the relative electrical permittivity of the thread core changes in the direction of extent. This may be done, for example, in that different materials or material combinations having a different relative permittivity of the thread core, respectively, are used. For example, a plastic material used for the manufacture of the thread core may be sectionwise combined or doped with at least one additional material in order to change the relative permittivity. A change of the relative permittivity can be achieved by the material and/or by the proportion of doping relative to the basic material of the thread core.

In one exemplary embodiment the thread core may contain a polymer material or consist of a polymer material. For example, the thread core may contain polyurethane and be made of elastane as in one exemplary embodiment. The at least one first conductor and/or the at least one second conductor may contain metal and be made of wires, in particular copper wires. For electrical insulation, the wires may be lacquer-coated or provided with a coating. Preferably, the conductors have a diameter of a maximum of 0.1 mm.

In one exemplary embodiment, the at least one first conductor and/or the at least one second conductor may extend in a multi-start helical line around the thread core.

As an alternative to the previously described embodiments, the two conductors may also be formed by a conductive layer that is applied to the thread core, wherein the conductive layers are electrically insulated relative to each other. Due to the insulator of the thread core and/or an additional layer, it is possible to change the capacitance per unit of length. Alternatively or additionally, the form also may be varied and, in particular, the layer thickness of at least one of the conductive layers may be varied so as to change the capacitance per unit of length.

According to a further embodiment, the capacitance of the sensory yarn may vary in the direction of extent as described hereinabove or may alternatively also be constant. In this embodiment, the sensory yarn comprises a photosensitive material. The photosensitive material may be a component of a thread core or be arranged on the thread core. Due to one or both of the effects described hereinafter, the photosensitive material may change the total capacitance of the capacitive component of the sensory yarn:

a) The photosensitive material is photostrictive and effects a length change of the sensory yarn in the direction of extent and/or obliquely or transversely thereto, when the intensity of the light impinging on the sensory yarn changes.

b) The photosensitive material changes its relative permittivity when the intensity of the light impinging on the sensory yarn changes.

As a result of this, the total capacitance of the capacitive component of the sensory yarn changes. Consequently, light impinging on the sensory yarn can be detected.

For the effect described under b) above, it is possible to use, for example, a zinc sulfide doped with copper (ZnS:Cu) or a doped semiconductor material. The free charges that can move in a restricted manner in the material form—independently of the intensity of the incident light—dipoles in the electrical field, as a result of which the relative permittivity and the thus measurable total capacitance changes.

The photostrictive material may be a polymer material and/or a semiconductor material and/or a ferroelectric material and/or a magnetic material and/or a magnetoelectric material. For example, the thread core may be made of a polymer material that is doped with a semiconductor material. Additionally or alternatively to being doped with a semiconductor material, the polymer material may also be doped with another suitable material, for example bismuth ferrite.

A sensory textile material part may comprise at least one sensory yarn according to the first inventive solution and/or at least one sensory yarn according to the second inventive solution. The textile material may be a knit or a woven material. The sensory yarns may be incorporated in a woven fabric, for example as the weft thread or as the warp thread. The sensory yarns may also be placed in a woven material or a knit material and held by the non-sensory yarns or threads in the textile material. Preferably, the sensory yarns are arranged in one direction of the textile material without cross-overs, preferably in the direction of the weft threads.

In one knit material, the at least one sensory yarn may be incorporated as the ground threads.

Other objects and advantages of the invention will become apparent upon reading the following detailed description and upon reference to the drawings.

BRIEF DESCRIPTION OF THE DRAWINGS

FIG. 1*a* is a fragmentary schematic of a sensory yarn having a capacitive component in accordance with the invention;

FIG. 1*b* is depiction of the electrical equivalent diagram of the illustrated capacitive component;

FIG. 2 is a fragmentary schematic of a sensory yarn according to one embodiment of the present invention;

FIG. 3 is a fragmentary schematic of a sensory yarn according to another embodiment of the present invention;

Figure 4A:
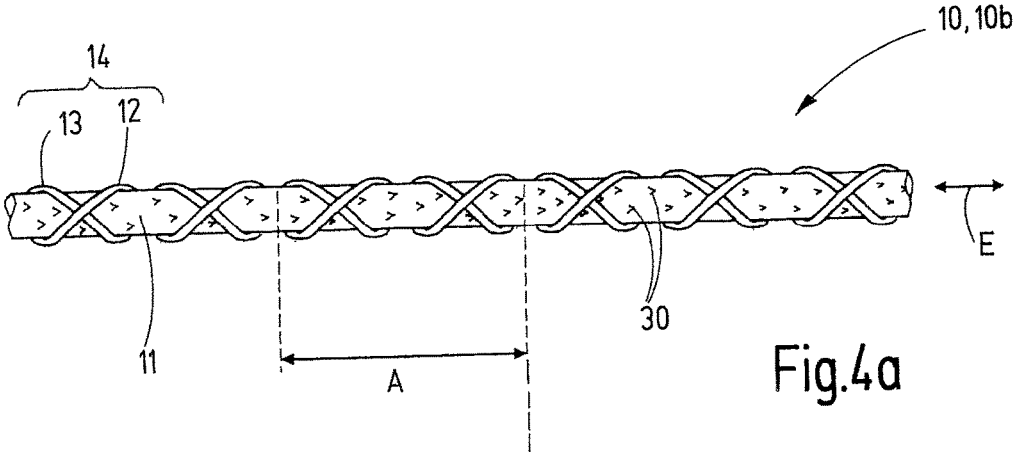
FIGS. 4*a* and 4*b* are fragmentary schematics of a sensory yarn comprising a photostrictive material in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Referring now more particularly to FIGS. 1-4 of the drawings, there is shown an illustrative sensory yarn 10 in accordance with the invention. The illustrated sensory yarn 10 has a thread core 11 extending in a direction of extent E. The thread core 11 may be monofilic or be formed of a plurality of fibers or filaments. The thread core 11 may be formed of a single uniform material or of a combination of several materials. In the exemplary embodiment, the thread core 11 comprises a polymer material. The thread core 11 is preferably elastically extendible in the direction of extent E and can be elastically stretched in the direction of extent E. In certain exemplary embodiments of the sensory yarn 10 the thread core 11 may comprise different materials and/or different material combinations and/or different proportions of materials of a material combination in the direction of extent E, which will be discussed in greater detail hereinafter.

At least one first conductor 12 and at least one second conductor 13 are wound around the thread core 11. In the exemplary embodiments illustrated here, respectively one single first conductor 12 and one single second conductor 13 are shown. In modification thereof, it is also possible for several first conductors 12 and second conductors 13, respectively to be present.

The conductors 12, 13 comprise an electrically conductive material, in particular metal, or they are made of such a material. In the exemplary embodiment, the conductors 12, 13 are made of a metallic wire, preferably a copper wire. In order to prevent an electrical connection between the two conductors 12, 13 and between the conductors 12, 13 and the thread core 11, the outside surface of the conductors 12, 13 is provided with an electrically insulating coating or an electrically insulating lacquer. In accordance with the example, the conductors have a diameter of up to 0.1 mm or 0.2 mm.

In accordance with the example, the first conductor 12 and the second conductor 13 form a conductor pair 14. The conductor pair 14 is a component of a capacitive component 15. The capacitive component 15 of a sensory yarn having a specific length exhibits a total capacitance CG. FIG. 1*b* shows the electrical circuit diagram for the sensory yarn 10 with the capacitive component 15.

The capacitance of the capacitive component 15 depends on the constructive design of the sensory yarn 10. The sensory yarn 10 may be manufactured in almost any desired length and wound on a spool. When the sensory yarn 10 is incorporated in a textile material part 16, a sensory yarn 10 having a specific length exhibits the total capacitance CG. This total capacitance CG changes when a load is applied to the sensory yarn 10, for example a force such as a pushing force or a pulling force. Due to a length change of the thread core 11 that acts as the insulator for the capacitative component 15 and/or due to a relative shift of the at least one first conductor 12 with respect to a second conductor 13, the total capacitance CG may change. As a result of this, the sensory yarn thus represents a capacitive sensor. Via an evaluating unit 17 that is electrically connected at one end of the sensory yarn 10 to the two conductors 12, 13, the actual total capacitance CG can be determined. Based on this, an effect on the sensory yarn 10 can be detected. The detectable effect on the sensory yarn 10 can be one or more of the following effects:

- a force such as, for example, a pushing force and/or a pulling force, or a force change;
- a media application using a fluid or vaporous medium;
- an approach of an object;
- a temperature change; and
- with reference to one embodiment of the sensory yarn, also a radiant exposure with electromagnetic waves, in particular with light.

FIGS. 2 and 3 illustrate a first embodiment of the sensory yarn 10, this embodiment being referred to as the first sensory yarn 10*a*. In the first sensory yarn 10*a*, the capacitive component 15 has a capacitance Cl per unit of length l of the sensory yarn, said capacitance changing in the direction of extent E. The capacitance Cl per unit of length l indicates the capacitance of the capacitive component 15 at the viewing location of the sensory yarn 10, wherein this capacitance Cl per unit of length l changes in the direction of extent E. Consequently, the total capacitance CG is thus not only a function of the length of a sensory yarn 10 in the direction of extent E, but varies, in addition, three-dimensionally in the direction of extent E. Two equal-length sections of a sensory yarn 10 may thus exhibit different degrees of total capacitance CG.

Considering the exemplary embodiments illustrated by FIGS. 2 and 3, the capacitance Cl per unit of length l changes section by section. As an example only, one first yarn section 21, one second yarn section 22, as well as one third yarn section 23, respectively, are shown. Each of the yarn sections 21, 22, 23 of the sensory yarn 10, or its capacitive component 15, exhibits a different capacitance c per unit of length l. In the exemplary embodiments illustrated here, the capacitance Cl per unit of length l is substantially constant in a given yarn section 21, 22, 23. In accordance with the example, the sensory yarn 10 in the first yarn section 21 exhibits a first capacitance $Cl_1$ per unit of length l, in the second yarn section 22 it exhibits a second capacitance $Cl_2$ per unit of length l, and in the third yarn section 23 it exhibits a third capacitance $Cl_3$ per unit of length l.

In modification of the sectionwise constant capacitances Cl per unit of length l, the capacitance Cl per unit of length l may also be continuously increased or decreased, at least sectionwise. For example, the capacitance Cl per unit of length l may be steadily increased from a minimum value of, e.g., 10 pF to a maximum value of 250 pF or more and/or, conversely, be steadily decreased from the maximum value toward the minimum value. Such continuously changing sections may also be provided so as to be successive in the sensory yarn 10.

Considering the embodiment of the first sensory yarn 10*a* illustrated by FIG. 2, the value of the capacitance Cl per unit of length l that changes in the direction of extent E is achieved in that the pitch S of a helical winding of the helically wound first conductor 12 and/or the second conductor 13 varies relative to the direction of extent E, i.e. relative to the longitudinal center axis of the sensory yarn 10. In the first yarn section 21, the pitch S of a helical winding of both conductors 12, 13 exhibits an amount of pitch $S_1$. Correspondingly, the pitch S of the helical windings of the first and second conductors 12, 13 in the second yarn section 22 exhibits a second amount of pitch $S_2$ and an amount of pitch $S_3$ in the third yarn section 22. As the amount of pitch increases, the number of windings per unit of length decreases and thus also the capacitance Cl per unit of length. The amounts of pitch are substantially constant in the respective yarn sections 21, 22, 23. Inasmuch as the pitch between two yarn sections 21 and 22 or 22 and 23 adjacent in the direction of extent frequently cannot be changed abruptly for manufacturing engineering reasons, one transition section 24, respectively, is provided between two adjacent yarn sections 21 and 22 or 22 and 23. In this transition section 24, the pitch of the first conductor 12 and/or the second conductor 13 is continuously increased or decreased in order to create a transition between the respective amounts of pitch $S_1$ and $S_2$ or $S_2$ and $S_3$. These transition sections 24 may optionally also be omitted if—due to the manufacturing process of the sensory yarn 10—a transition location with abruptly changing pitch between two yarn sections 21, 22 exhibiting different amounts of pitch can be produced.

In the exemplary embodiments of the first sensory yarn 10*a* the amounts of pitch for both conductors 12, 13 are the same, however, have different signs. As a result of this, intersecting locations in the windings of the two conductors 12, 13 are formed. It is not absolutely necessary that the amounts of pitch for the two conductors 12, 13 in a yarn section 21 be the same, rather the amounts of pitch of the two conductors 12, 13 may also be different from one another. Furthermore, between the two adjacent yarn sections exhibiting different capacitances Cl per unit of length l, it is also possible to change only the pitch of the first conductor 12 or the second conductor 13.

FIG. 3 illustrates another alternative for changing the capacitance Cl per unit of length l for the capacitive component 15. In this embodiment, the pitch of the winding of the two conductors 12, 13 in the different yarn sections 21, 22, 23 may remain substantially unchanged. In order to change the capacitance Cl per unit of length, for example the dielectric number or permittivity c is changed. To do so, the insulator that, for example, is the thread core 11, is changed in sections. In accordance with the example, the thread core exhibits a first permittivity $\varepsilon_1$ in the first yarn section 21, a second permittivity $\varepsilon_2$ in the second yarn section 22 and a third permittivity $\varepsilon_3$ in the third yarn section 23. The different permittivities are achieved with different materials or material compositions in the yarn sections 21, 22, 23. For example, the thread core 11 may comprise an at least sectionwise doped base material. In doing so, it is useful if the permittivity of the base material differs sufficiently from the added doping material—for example, by at least 10 to 30%. For changing the permittivity ε, it is possible, for example, to increase the proportion of doping material relative to the base material. Additionally or alternatively, the use of various doping materials or various combinations of doping materials in the various yarn sections 21, 22, 23 is possible.

In the preferred exemplary embodiments described herein, the permittivity that changes the material is incorporated as the doping material in the base material of the thread core 11. Furthermore, it would also be possible to provide a coating enclosing the thread core 11 and the conductors 12, 13, said coating containing or consisting of a material that changes the permittivity.

It will be understood that it is further possible to vary the permittivity ε, as well as the pitch of the windings, to change the capacitance Cl per unit of length l and to thus combine with each other the exemplary embodiments of the first sensory yarn 10*a* as illustrated in FIGS. 2 and 3 and described hereinabove.

Figure 5:
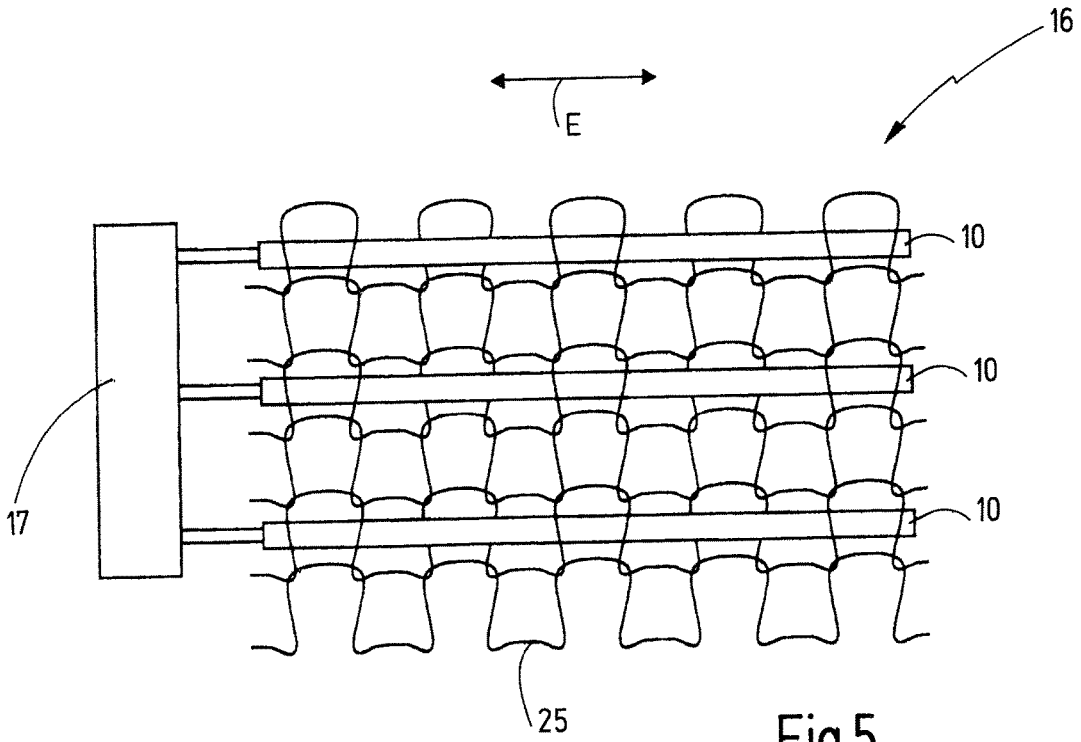
FIG. 5 is a schematic of a knitted textile material comprising a plurality of sensory yarns in accordance with the invention.
Figure 6:
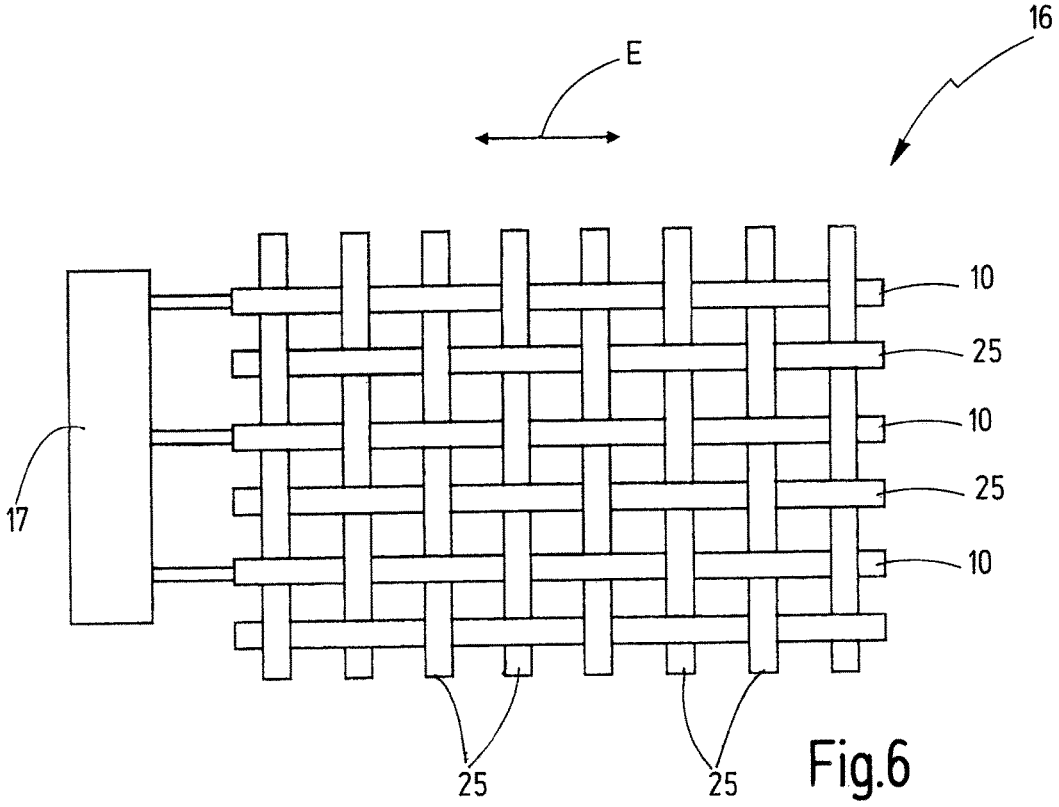
FIG. 6 is a schematic of a weaved textile material comprising a plurality of sensory yarns in accordance with the invention.

With the use of the first sensory yarn 10 it is possible to produce a sensory textile material part 16 as schematically illustrated by FIGS. 5 and 6. With the use of the sensory yarn 10, it is possible to detect effects such as, for example, the effect of a force, for example a pushing force and/or a pulling force, effects due to liquid media, for example water, approaching objects, and the like. As a result of the fact that the capacitance Cl per unit of length l of the sensory yarn 10 in the direction of extent E changes, the sensory yarn 10 provides location information by means of which it is possible to detect the position of the effect. In particular if several sensory yarns 10 are arranged parallel to each other in a textile material part 16, the effect affects, as a rule, not only the total capacitance CG of a single sensory yarn 10 but the total capacitance CG of several sensory yarns 10. By evaluating the combination of the changing total capacitances CG it is possible to perform a highly accurate localization of the effect on the textile material part 16, without requiring a matrix-like arrangement of sensory yarns 10 with intersecting location. This has the advantage that the textile material part 16 needs to be electrically contacted only on one side for the connection of the evaluating unit 17. This considerably simplifies the design of a sensory textile material part 16.

As is schematically shown in FIGS. 5 and 6, the textile material part 16 may be knit goods, for example a knit (FIG. 5) or a weave (FIG. 6). In the knit shown by FIG. 5 the sensory yarns 10 are placed in the knit material as ground threads and do not themselves participate in the stitch formation. In the exemplary embodiment shown in FIG. 6, the sensory yarns 10 are incorporated as the weft thread in a woven material. In doing so, depending on the application, one or more conventional, non-sensory textile threads 25 may be woven between two sensory yarns 10. The number and density of the sensory yarns in a textile material part 16 depend on the specific case of application.

In addition to the parallel-arranged sensory yarns 10, the textile material 16 comprises one or more conventional textile threads 25. The non-sensory textile thread 25 may be used for the stitch formation (FIG. 5) or as the weft thread and the warp thread (FIG. 6).

The representations of FIGS. 5 and 6 are not true to scale and are only schematic. The sensory yarns 10 may have the same strengths or different strengths (titer) than the other textile threads 25 that are used.

Figure 4B:
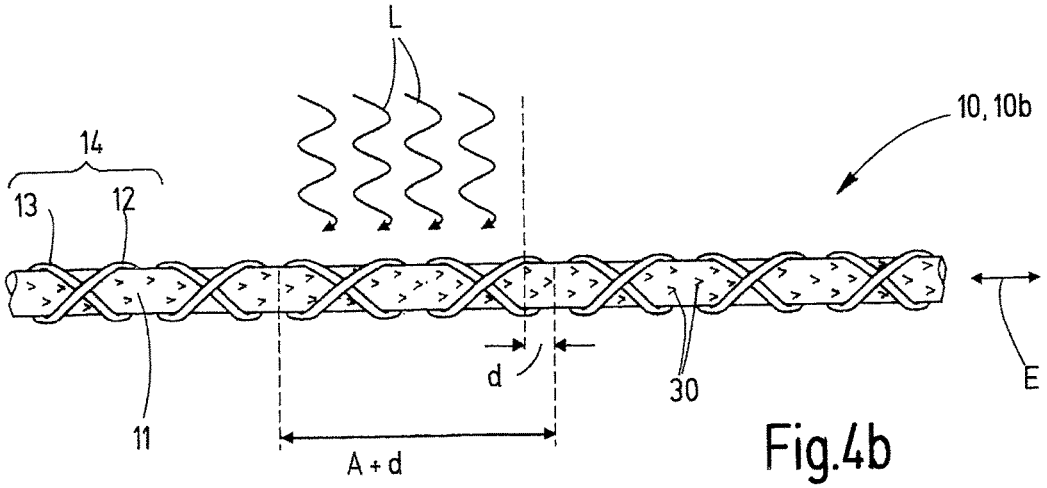

FIGS. 4*a* and 4*b* show a second exemplary embodiment of the sensory yarn 10 that is referred to as the second sensory yarn 10*b*. In the second sensory yarn 10*b*—different from the first sensory yarn 10*a*—the capacitance Cl per unit of length l that comprises the capacitive component 15 of the sensory yarn 10 may be substantially constant. However, it is also possible to provide the capacitance Cl per unit of length l changing in the direction of extent E as in the first sensory yarn 10*a*.

The second sensory yarn 10*b* contains a photosensitive material 30. This photosensitive material 30 may be applied to any location on the sensory yarn 10 or be incorporated in the sensory yarn 10. In the preferred exemplary embodiment described herein the photosensitive material 30 is incorporated as a doping material in the base material of the thread core 11. As an alternative thereto, the thread core 11 may also consist of photosensitive material. Furthermore, it is also possible to provide a coating that encloses the thread core 11 and the conductors 12, 13, said coating containing or consisting of the photosensitive material 30.

With reference to FIGS. 4*a* and 4*b*, it is shown schematically that by radiant exposure of the second sensory yarn 10*b* with light L a length change of the thread core 11 occurs due to photostriction. For example, the length of a length section A changes by a difference d when the second sensory yarn 10*b* has radiant exposure to light L. This, in turn, causes a change of the total capacitance CG of the sensory yarn 10 that has been exposed to a radiation with light L. When the intensity of the incident light L changes, so does the total capacitance CG.

The photostrictive material 30 may be, for example, a polymer material, a semiconductor material, a ferroelectric material, a magnetic material or a magnetoelectric material. For example, bismuth ferrite may be used as the photostrictive material.

Figure 4C:
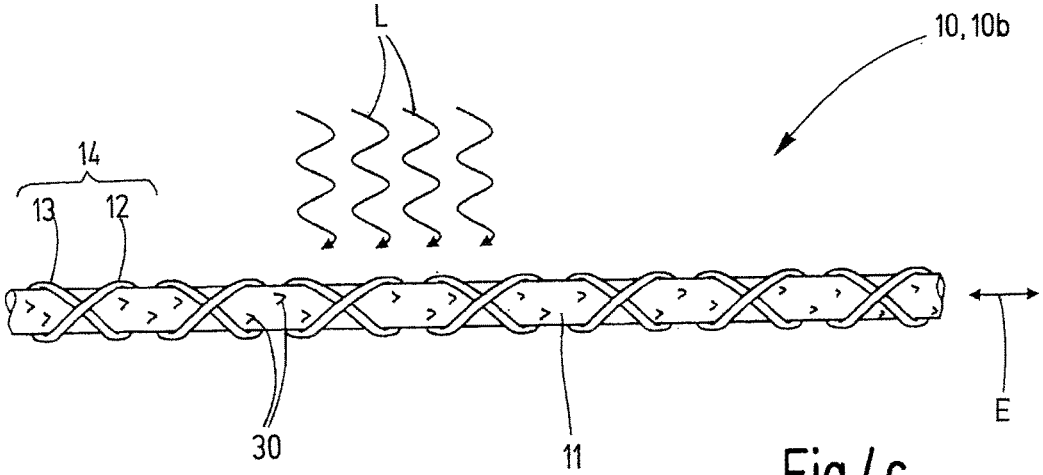
FIG. 4*c* is a fragmentary schematic of another sensory yarn in accordance with the invention comprising a photosensitive material.

In the exemplary embodiment of a photosensitive second sensory yarn 10*b* illustrated in FIG. 4*c* no length change (photostriction) takes place. Rather, in that case the photosensitive material is selected in such a manner that a change of the permittivity occurs due to the intensity of the light. For example, a doped semiconductor material such as possibly a zinc sulfide doped with copper (ZnS:Cu) can be used. Depending on the light intensity, dipoles form in the electrical field and change the permittivity, which, in turn, changes the detectable total capacitance of the second sensory yarn 10*b*.

The photosensitive second sensory yarn 10*b* can thus be used to detect the presence of incident light L or an intensity change. For example, an illumination sensor or also a brightness sensor could be implemented in this manner. Such a sensor could be integrated with the use of the sensory yarn 10*b* in a shading textile, for example, a sun shade or the like that is moved out of or into a retracted position as a function of incident sun light. The sensor system could thus be an integral part of a sun protection shade and a separate sensor could be dispensed with.

Figure 7:
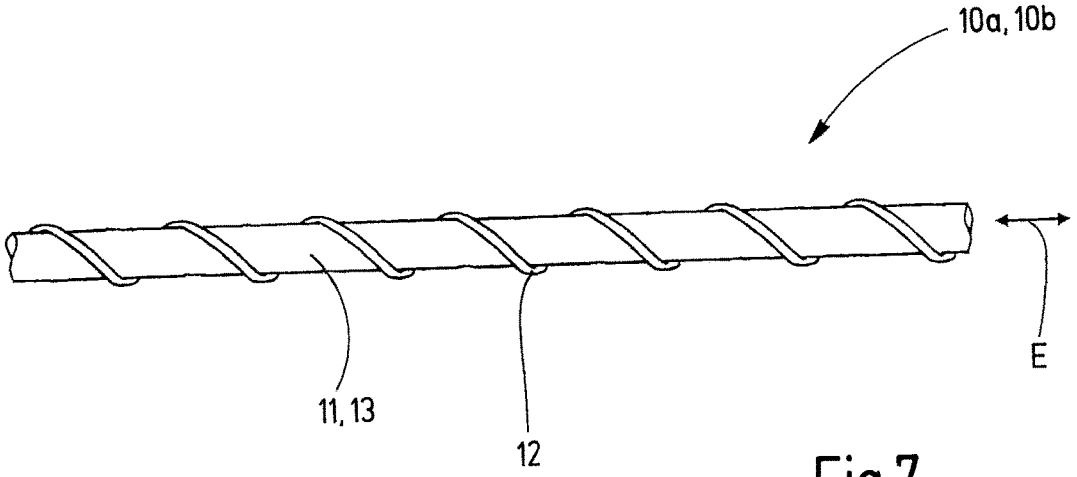
FIGS. 7 and 8 are schematics of a further modified embodiment of a sensory yarn in accordance with the invention.
Figure 8:
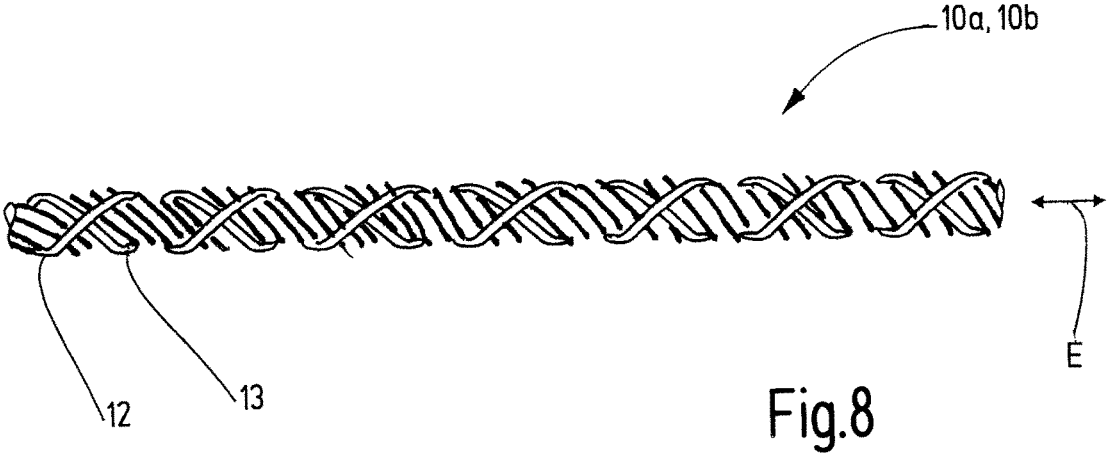

In both sensory yarns 10*a*, 10*b*, one of the two conductors, for example the second conductor 13, can be formed by the thread core 11 (FIG. 7). The sensory yarn 10*a*, 10*b* may also be configured without the thread core 11 in the form of a twisted yarn (FIG. 8). If there is no thread core 11, the two conductors 12, 13 are combined together with other filaments (hatching in FIG. 8) to form the twisted yarn.

In all the embodiments of the first sensory yarn 10*a*, and preferably of the second sensory yarn 10*b*, at least one of the two conductors is helically would in the direction of extent E.

The first sensory yarn 10*a* and the second sensory yarn 10*b* may also be used together in a textile material part 16 when the effect of light L, as well as an object approaching the textile material part 16 and/or a force effect on the textile material part 16 and/or an effect due to a liquid or vaporous medium and/or another total capacitance CG of an effect influencing the sensory yarn 10 is to be detected.

From the foregoing, it can be seen that a sensory yarn 10 is provided having a thread core 11, around which a first conductor 12 and a second conductor 13 are helically wound. The two conductors 12, 13 are electrically insulated from each other and from the thread core 11. The two conductors 12, 13 form a capacitive component 15 together with the thread core 11. In the case of a first sensory yarn 10*a*, the capacitance Cl per unit of length changes in the direction of extent E of the sensory yarn. This can be accomplished by a change in the winding geometry of the first conductor 12 or of the second conductor 13 or by a change of the relative permittivity c of the sensory yarn 10. A second sensory yarn 10*b* has photosensitive material 30, and therefore a length change can be caused by incident light L. As a result of a length change or other deformation of the sensory yarn 10*a*, 10*b*, the total capacitance CG of the sensory yarn 10*a*, 10*b* in question changes, which can be determined by means of an evaluating unit 17.

LIST OF REFERENCE SIGNS

10 Sensory yarn
10*a* First sensory yarn
10*b* Second sensory yarn
11 Thread core
12 First conductor
13 Second conductor
14 Conductor pair
15 Capacitive component
16 Textile material part
17 Evaluating unit
21 First yarn section
22 Second yarn section
23 Third yarn section
24 Transition section
25 Textile thread
30 Photosensitive material
A Length section
Cl Capacitance per unit of length
$CL_1$ First capacitance per unit of length
$CL_2$ Second capacitance per unit of length
$Cl_3$ Third capacitance per unit of length
CG Total capacitance
d Difference
E Direction of extent
ε Relative permittivity
$\varepsilon_1$ First relative permittivity $\varepsilon_2$ Second relative permittivity
$\varepsilon_3$ Third relative permittivity
l Unit of length
L Light
$S_1$ First amount of pitch
$S_2$ Second amount of pitch
$S_3$ Third amount of pitch

The invention claimed is:

1. A textile material part (16) comprising:

a plurality of sensory yarns (10, 10*a*, 10*b*), wherein at least one sensory yarn (10*a*) of the plurality of sensory yarns (10, 10*a*, 10*b*) comprises:

a thread core (11) extending in a direction of extent (E);

at least one first conductor (12) and at least one second conductor (13), at least one of said first and second conductors (12, 13) being helically wound relative to the direction of extent (E), said at least one first conductor (12) and at least one second conductor (13) being components of a capacitive component (15) and are electrically isolated relative to each other; and said capacitive component (15) having a capacitance (Cl) per unit of length (l) of the sensory yarn (10), and said capacitance (Cl) changes in the direction of extent (E).

2. The textile material part (16) of claim 1 in which one of said first and second conductors (12, 13) is a component of said thread core (11) and the other of said first and second conductor (13) is wound around the thread core (11).

3. The textile material part (16) of claim 1 in which at least one of said first and second conductors (12, 13) is helically wound around said thread core (11).

4. The textile material part (16) claim 1 in which said capacitive component (15) has a capacitance (Cl) per unit of length (l) in a first yarn section (21) that is different from the capacitance (Cl) per unit of length (l) in another yarn section (22, 23).

5. The textile material part (16) of claim 4 in which said capacitive component (15) has at least two yarn sections (21, 22, 23) that have a constant capacitance ($Cl_1$, $Cl_2$, $Cl_3$) per unit of length (l).

6. The textile material part (16) of claim 1 in which said capacitive component (15) has two adjacent yarn sections (21, 22 or 22, 23) having different capacitances ($Cl_1$, $Cl_2$, $Cl_3$) per unit length (l) and between said two adjacent yarn sections there is a transition section (24) having a capacitance (Cl) per unit of length that changes continuously.

7. The textile material part (16) of claim 1 in which said capacitive component (15) has a capacitance (Cl) per unit of length in a direction of extent (E) that changes by at least 0.03 pF.

8. The textile material part (16) of claim 7 in which said capacitive component (15) has a capacitance (Cl) per unit of length in a direction of extent (E) that changes to a maximum capacity of 250 pF.

9. The textile material part (16) of claim 1 in which said capacitive component (15) has at least three yarn sections (21, 22, 23) having different capacitances ($Cl_1$, $Cl_2$, $Cl_3$) per unit of length (l), and the capacitance (Cl) per unit length of said capacitive component between said yarn sections (21, 22, 23) changes in the direction of extend (E) by at least 10 pF.

10. The textile material part (16) of claim 1 in which the change of capacitance (Cl) per unit length (l) of said capacitive component (15) is effected by a changing number of helical windings or pitch of the helical windings per unit of length of the thread core (11) in the direction of extent (E).

11. The textile material part (16) of claim 1 in which the change of the capacitance (Cl) per unit length (l) of said capacitive component (15) is effected by a changing permittivity ($\varepsilon$) of the sensory yarn (10*a*) in the direction of extent (E).

12. The textile material part (16) of claim 1 in which said thread core (11) contains a polyester material.

13. The textile material part (16) of claim 1 in which at least one of said first and second conductors (12, 13) contains metal.

* * * * *